US006796344B2

(12) United States Patent
Chen et al.

(10) Patent No.: US 6,796,344 B2
(45) Date of Patent: Sep. 28, 2004

(54) HANDBAG HAVING FUNCTIONAL DEVICES SECURED BY MAGNETICALLY ATTRACTABLE DEVICES

(75) Inventors: Chi Yueh Chen, Taipei (TW); Ahron Hersh, Brooklyn, NY (US)

(73) Assignee: Rosetti Handbags and Accessories, Ltd., New York, NY (US)

( * ) Notice: Subject to any disclaimer, the term of this patent is extended or adjusted under 35 U.S.C. 154(b) by 0 days.

(21) Appl. No.: 09/931,222

(22) Filed: Aug. 16, 2001

(65) Prior Publication Data

US 2002/0153074 A1 Oct. 24, 2002

Related U.S. Application Data

(60) Provisional application No. 60/285,395, filed on Apr. 20, 2001.

(51) Int. Cl.[7] ..... A45C 1/08
(52) U.S. Cl. ..... 150/113; 190/109
(58) Field of Search ..... 150/113, 112, 150/114, 117, 104, 105, 152, 148, 106; 190/109, 110, 100, 901, 902; 105/113, 104, 105, 112, 152, 148

(56) References Cited

U.S. PATENT DOCUMENTS

| | | | | |
|---|---|---|---|---|
| 2,413,465 A | | 12/1946 | Ohlsen | |
| 2,544,493 A | | 3/1951 | Filenbaum | |
| 2,562,499 A | * | 7/1951 | Lifton | 150/113 |
| D256,631 S | | 9/1980 | Workman | |
| D260,198 S | | 8/1981 | Siegel | |
| 4,569,082 A | * | 2/1986 | Ainsworth et al. | 383/3 |
| D293,508 S | | 1/1988 | Marconi | |
| 4,739,809 A | | 4/1988 | Adams | |
| 4,754,790 A | * | 7/1988 | Meyers | 150/104 |
| 4,941,235 A | | 7/1990 | Aoki | |
| 5,142,746 A | | 9/1992 | Morita | |
| 5,152,035 A | | 10/1992 | Morita | |
| 5,207,254 A | | 5/1993 | Fromm | |
| 5,208,951 A | | 5/1993 | Aoki | |
| 5,249,338 A | | 10/1993 | Aoki | |
| 5,251,362 A | | 10/1993 | Riceman et al. | |
| 5,274,889 A | | 1/1994 | Morita | |
| 5,379,495 A | | 1/1995 | Riceman et al. | |
| 5,400,479 A | | 3/1995 | Medina et al. | |

(List continued on next page.)

FOREIGN PATENT DOCUMENTS

DE 3243577 5/1984

OTHER PUBLICATIONS

Seamon, US 2002/0121322, Sep. 5, 2002.*
International Search Report for corresponding International Application No. PCT/US02/12442 dated Jul. 19, 2002.
US 09/749,364 filed Dec. 27, 2000.

*Primary Examiner*—Lien Ngo
(74) *Attorney, Agent, or Firm*—Abelman, Frayne & Schwab

(57) ABSTRACT

A handbag is disclosed which comprises an enclosure having opposed front and rear walls, opposed sidewalls, a bottom wall and side walls defining a storage space. A closure panel is associated with at least one of the walls and arranged for pivotal movement toward and away from the at least one wall so as to define a compartment therebetween. At least one first magnetically attractive device is associated with the at least one wall. A functional device such as a wallet, change purse or the like, is arranged for separable attachment within the compartment, the functional device having associated therewith at least one second magnetically attractive device for removably attaching the functional device within the compartment by positioning the first and second magnetically attractive devices in opposed relation so as to develop mutual magnetic attractive force between said at least one first and second magnetically attractive devices. A method of separably attaching a functional device such as a wallet to a handbag is also disclosed.

17 Claims, 4 Drawing Sheets

U.S. PATENT DOCUMENTS

| | | | | |
|---|---|---|---|---|
| 5,448,806 | A | | 9/1995 | Riceman et al. |
| 5,473,799 | A | | 12/1995 | Aoki |
| 5,611,120 | A | | 3/1997 | Riceman et al. |
| 5,675,874 | A | | 10/1997 | Chen |
| 5,725,039 | A | | 3/1998 | Macinai et al. |
| 5,749,447 | A | | 5/1998 | Hersh et al. |
| 5,881,787 | A | | 3/1999 | Davis et al. |
| 5,920,966 | A | | 7/1999 | Chen |
| 5,937,487 | A | | 8/1999 | Bauer |
| 5,983,464 | A | | 11/1999 | Bauer |
| 5,987,715 | A | | 11/1999 | Khon |
| 6,009,601 | A | | 1/2000 | Kaufman |
| 6,070,628 | A | | 6/2000 | Nastasi |
| 6,120,162 | A | | 9/2000 | Guerrieri |
| 6,170,131 | B1 | | 1/2001 | Shin |
| 6,179,025 | B1 | * | 1/2001 | Sutton ..... 150/105 |
| 6,186,201 | B1 | * | 2/2001 | Salz ..... 150/105 |
| D441,527 | S | | 5/2001 | Hersh et al. |
| 6,295,702 | B1 | | 10/2001 | Bauer |
| 6,304,162 | B1 | | 10/2001 | Nakatsuka et al. |
| 6,364,110 | B2 | * | 4/2002 | Johnson ..... 206/425 |

* cited by examiner

HANDBAG HAVING FUNCTIONAL DEVICES SECURED BY MAGNETICALLY ATTRACTABLE DEVICES

CROSS-REFERENCE TO RELATED APPLICATIONS

This application claims priority to Provisional Application No. 60/285,395, filed Apr. 20, 2001, the disclosure of which is incorporated by reference herein.

BACKGROUND OF THE INVENTION

1. Field of the Invention

This invention relates to handbags and other personal carrying containers, and more particularly, to a handbag having an enclosure which defines a storage space wherein functional devices such as organizers, change wallets, eyeglass holders, mobile phone holders and the like are removably secured in position thereto by magnetically attractable devices.

2. Description of the Related Art

The structure and use of handbags, satchels, and other personal carrying containers is generally well-known. Such handbags and carrying containers generally include an enclosure which defines a large interior compartment that is often subdivided into smaller pockets or regions for separation and storage of objects such as organizers, wallets, change purses, lipstick holders and articles in general.

The use of magnetically attractable devices in conjunction with such handbags is also well known. For example, it is well-known to use magnetically attractable fasteners as closures, latches or the like for such handbags. One example of a magnetic fastener for use with such handbags is disclosed in U.S. Pat. No. 5,675,874 to Chen which relates to a magnetic closure device adaptable for use with such handbags or other enclosures. Commonly assigned U.S. patent application Ser. No. 09/749,364 filed Dec. 27, 2000 relates to a handbag having compartmentalized storage space and magnetic closure panel wherein magnetically mutually attractable closure devices are respectively positioned on each of at least one wall and the closure panel, the devices being arranged to magnetically assist movement of the closure panel towards a closed position and to retain the closure panel in the closed position adjacent to at least one wall of the compartment. Commonly assigned U.S. Pat. No. 5,749,447 relates to a handbag having compartmentalized storage area. The disclosures of U.S. Pat. Nos. 5,675,874; 5,749,447, and U.S. patent application Ser. No. 09/749,364 are incorporated herein by reference and made a part of this disclosure.

Up to the present, although it has been known to utilize magnetically mutually attractable devices to provide closure and to assist latches for such closures on handbags, satchels, suitcases and in general on article carrying devices, the use of magnetically mutually attractable devices to retain functional components of the handbag in assembled relation while permitting separation thereof for such functional reasons is yet unknown. The present invention relates to a handbag wherein a device having a specific function such as an organizer, wallet, change purse or the like, which is generally permanently secured to the handbag, is now removable secured in position with respect to the handbag by magnetically attractable devices so as to give the appearance of a permanent assembly, while separation of the functional device from the handbag is readily permitted by manual separation of the magnetically attached components and removal of the device from the handbag.

SUMMARY OF THE INVENTION

A device, preferably a handbag, is disclosed for carrying articles or the like which comprises, an enclosure, a functional device for carrying articles, information or the like, such as a wallet, change purse or the like, the functional device being removably positionable with respect to a preselected portion of the enclosure, and mutually magnetically attractable devices respectively associated with the enclosure and the functional device for retaining the functional device in position with respect to the enclosure by magnetic attractive force, while permitting separation of the functional device from the enclosure. The enclosure is preferably comprised of opposed front and rear walls, opposed side walls, and a bottom wall, the walls defining a storage space. The mutually magnetically attractable devices preferably comprise at least one magnetic or magnetizable device associated with at least one portion of the enclosure and at least one mutually magnetically attractable device associated with at least one portion of the functional device. The enclosure preferably forms at least part of a handbag.

The magnetically attractable devices preferably comprise at least one magnet and at least one magnetically attractable device positioned in opposed adjacent relation with each other, the magnet for providing magnetic force for separably retaining the functional device adjacent at least a portion of the enclosure and the magnetically attractable device being either a magnet or a ferromagnetic material device capable of attraction to the magnet.

In the preferred embodiment a handbag comprises an enclosure having at least opposed front and rear walls, opposed side walls, and a bottom wall, the walls defining a storage space. First magnetically attractable device is associated with at least a portion of the enclosure, and at least one functional device such as a wallet or the like having at least one wall portion having second magnetically attractable device associated therewith. The wall portion is positionable adjacent the first magnetically attractable device, such that the first and second magnetically attractable devices are positioned in adjacent relation whereby the functional device may be separably attached to the enclosure by magnetic attractive force, while permitting separation of the functional device from the enclosure by movement of the magnetically attractable devices away from each other.

BRIEF DESCRIPTION OF THE DRAWINGS

Preferred embodiments of the invention are described hereinbelow with reference to the drawings, wherein.

DETAILED DESCRIPTION OF THE INVENTION

Figure 1:
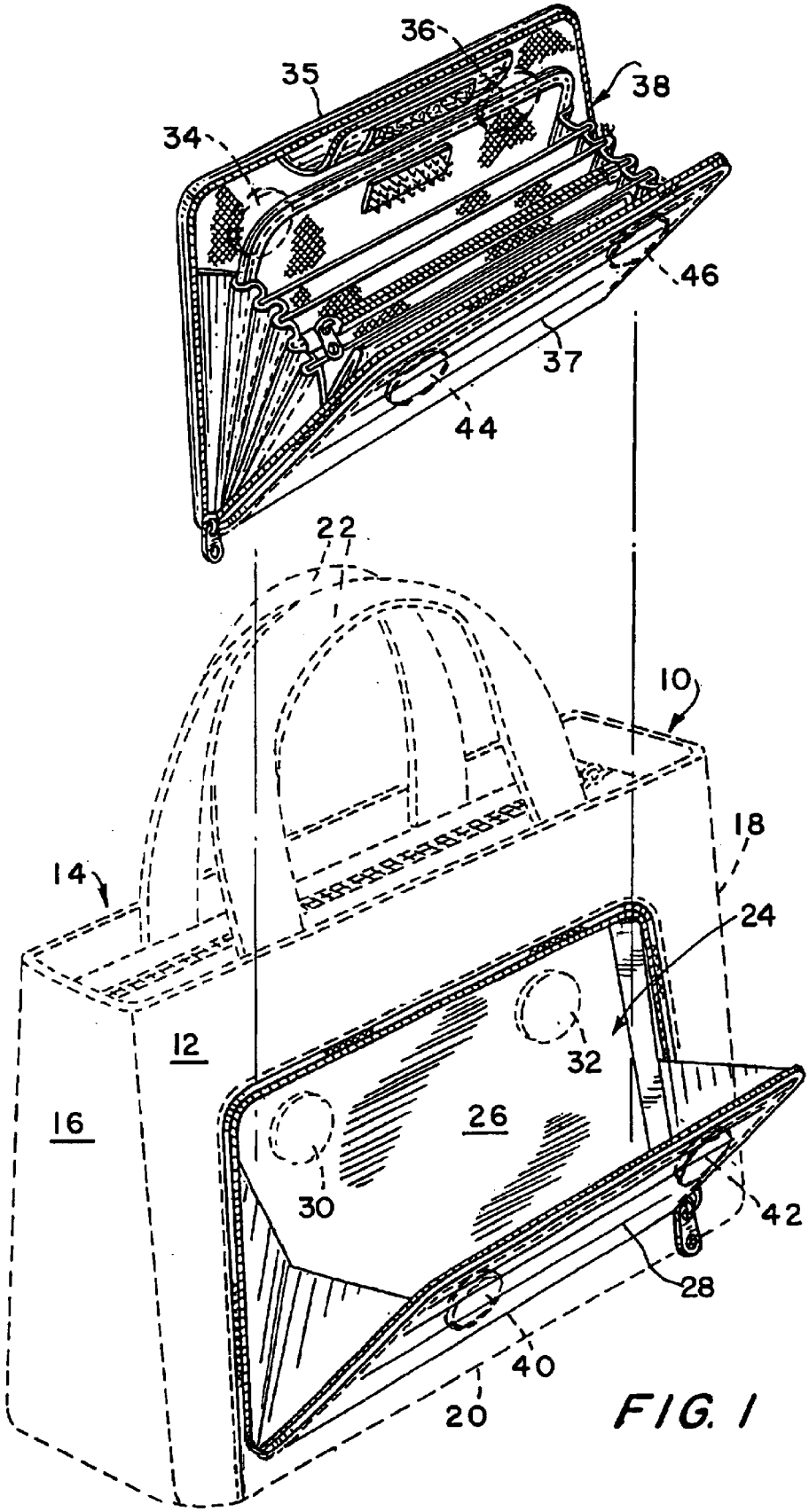
FIG. 1 is a left front perspective view from above, of a handbag having an organizer-type wallet removably secured in position into a compartment which is closable by a closure panel, the organizer wallet being retained in position within the compartment of the handbag by magnetically mutually attractable devices respectively positioned on a wall of the compartment, on the organizer wallet, and on the closure panel, the handbag being shown in broken lines for environmental purposes only.

Although the present invention is disclosed in conjunction with a handbag or the like utilizing magnetically mutually attractable devices to secure an organizer-type wallet within a compartment formed by the handbag, it is believed that the present invention may be best characterized by the incorporation of magnetically mutually attractable devices within any type of carrybag to retain any type or number of functional devices in a manner to permit separation of the functional device or devices from the handbag. The functional devices which are contemplated are such devices that are normally permanently assembled with the handbag, such as organizer-type wallets, change purses or the like. In the preferred embodiment disclosed herein, an organizer-type wallet of the type which is generally permanently incorporated into the handbag is now removably attached to the handbag by means of magnetically mutually attractable devices, the organizer-type wallet being readily removable from the handbag in a manner previously not known in the art. Reference herein to a magnet being "embedded" in a wall or panel means that the magnet is mounted between various layers of materials which form the wall or panel, such as leather, vinyl, cloth, cardboard or the like.

As noted hereinabove, the use of magnets and magnetic devices is generally known to separately secure items together. However, it is believed that the use of magnets, particularly of the rare earth type, and particularly of neodymium metal, provide such substantial magnetic attraction to magnets of the same type, or alternatively to mutually magnetically attractable materials, including magnetizable materials such as a ferromagnetic material, e.g. magnetic iron, steel or the like, that retention of such items such as wallets, eyeglass holders organizers or the like is now possible without fear of loss of the device. Furthermore, while magnetic materials such as neodymium or other rare earth magnetic materials may in certain circumstances (e.g. when uncovered) damage magnetic strips of credit cards or the like, it has been found that by mounting such magnetic devices in handbags in the manner disclosed herein, wherein the magnetic devices are embedded in a wall or panel; i.e., they are covered or generally surrounded by leather, cardboard, fabric or other materials, damage to credit cards passing adjacent or over the magnets is virtually impossible. Furthermore, wherever reference is made herein to "mutually magnetically attractive materials", such materials as magnets and magnetically attractive materials, including magnetizable materials such as iron, steel, or other magnetizable materials, are contemplated. Having disclosed such background relating to magnetically attractive materials and handbags, reference is now made to the drawings in connection with the description of the present invention. As noted hereinabove, the disclosures of U.S. Pat. Nos. 5,675,874; 5,749,447, and U.S. patent application Ser. No. 09/749,364 are incorporated herein by reference and made a part of this disclosure.

Referring initially to FIG. 1 there is shown a typical ladies handbag 10 in broken lines for environmental purposes only. As noted, although a ladies handbag is shown in FIG. 1 the invention may also be incorporated into other carry containers such as general carrybags, satchels, suitcases, gym bags or the like. Referring again to FIG. 1, the handbag is defined by an enclosure having front wall 12, rear wall 14, left-side wall 16, right-side wall 18, bottom wall 20 and carry handles 22. Front wall 12 includes an opening which defines a compartment 24 having recessed wall 26 and closure panel 28 which is pivotally attached to front wall 12 for pivotal movement toward and away from the front wall 12 for to close and open the compartment, respectively.

In FIG. 1, recessed wall 26 of compartment 24 includes disc-like magnets 30, 32 which are preferably made of cerium rare earth metal such as neodymium or the like. Such magnets provide a substantial magnetic force to other magnets of the same type, or alternatively to magnetically attractable materials such as other magnetizable materials including ferromagnetic iron, steel, or the like. The magnets 30, 32 are attached within internal compartment wall 26 for mutual attraction to magnets 34, 36 of the same type embedded in a rear wall 35 of organizer-type wallet 38 shown separated from handbag 10 in FIG. 1. In the same manner, rare earth magnets 40, 42 are attached within the closure panel 28 for mutual attraction to similar magnets, or alternatively, to magnetically mutually attractable disc-like magnetizable members 44, 46 which may be of metal and which are embedded or attached within the front wall 37 of the organizer type wallet 38. As noted hereinabove, provided that at least one of the walls contains a magnet, the attractive wall need only contain a magnetically mutually attractable device or another magnet preferably of opposite facing plurality, for attraction of the walls to each other. In such instances a magnetizable device such as iron or steel disc or strip will provide the requisite attractive force.

It can be readily appreciated that the organizer type wallet is removably attached within the compartment 24 of the handbag by simply placing the wallet into the compartment and permitting neodymium magnets 30, 32 to be attracted to mutually magnetically attractable magnets 34, 36 of the wallet and neodymium magnets 40, 42 being attracted to the magnetically mutually attractable magnets 44, 46 of the organizer-type wallet. When the user desires to remove the organizer wallet 38 from the compartment 24 of the handbag 10, the outer walls 35, 37 of the wallet are merely separated from internal wall 26 and closure panel 28, respectively of the handbag. The wallet is then conveniently lifted away from the compartment and the handbag and upon completion of the use of the organizer-type wallet outside of the handbags, the wallet may be reinserted into the compartment 24 of the handbag.

Figure 2:
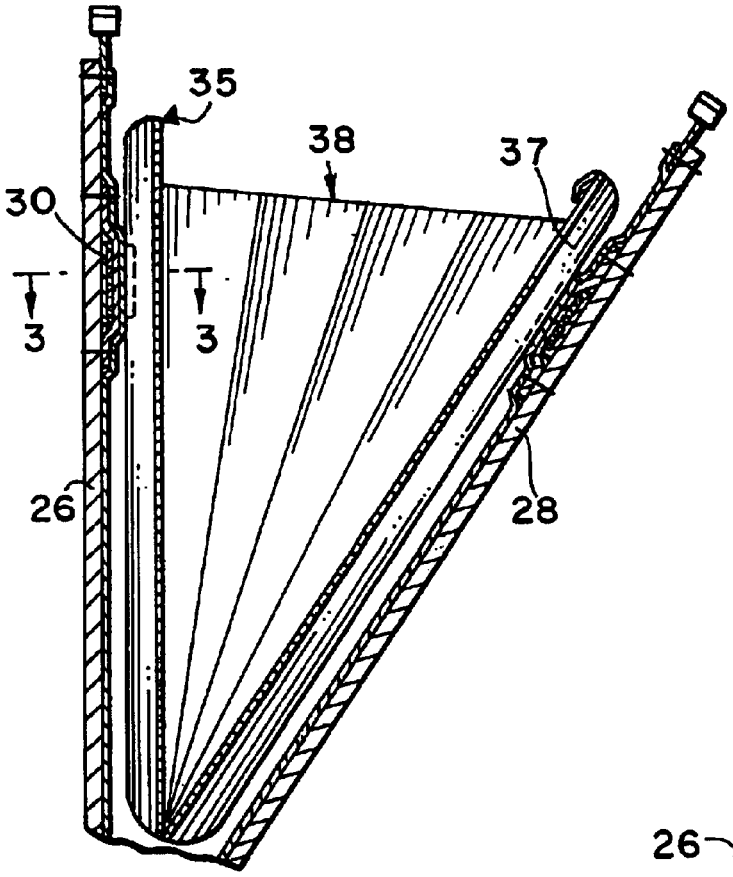
FIG. 2 is a left side elevational view of the handbag and organizer wallet shown in FIG. 1, the internal wall of the compartment and the compartment closure panel being shown in cross-section, and the organizer wallet being shown in vertical elevation.

Referring now to FIG. 2 there is shown inner panel 26 of the compartment of the handbag in cross-sectional view, and closure panel 28 of the compartment of the handbag also shown in cross-sectional view. The organizer-type wallet 38 is shown in position between internal wall 26 and closure panel 28, and attached by the mutually magnetically attractable magnets described in conjunction with FIG. 1, wherein rear wall 35 and front wall 37 of the organizer-type handbag are attached to the respective wall 26 of the compartment and the closure panel 28, respectively.

Figure 3:
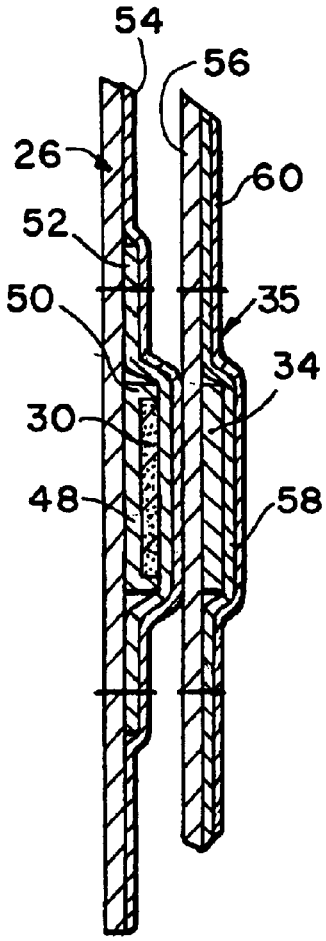
FIG. 3 is a cross-sectional view taken along lines 3—3 of FIG. 2, illustrating the internal wall of the compartment having a magnetic device embedded therein and the wall of the organizer-type wallet having a magnetically mutually attractable device embedded therein for mutual attachment thereof to each other in order to removably secure the organizer wallet in position within the internal compartment of the handbag.

Referring now to FIG. 3 there is shown a cross-sectional view taken along lines 3—3 of FIG. 2, wherein internal panel 26 of compartment 24 is structured to secure the neodymium type magnet 30 thereto. An exemplary structure is disclosed in FIG. 3 wherein the internal wall 26 of handbag 10 may be formed of leather, vinyl or the like and the neodymium magnet 30 is encased in a disc-like shaped encasement 48 (or coating) formed of a magnetizable material, preferably a ferromagnetic material such as iron or steel, which is disc-like in configuration and having a peripheral rim 50 which covers the side edge of the disc-like magnet 30 as shown. The purpose of the case (or coating) 48 of the magnet 30 is to attract the magnetic field closer to the case in order to concentrate the magnetic field in a manner where the force provided on the opposite side of the encasement is increased and is more substantial in magnitude to be attracted to the magnetically mutually attractive device associated with the organizer wallet. In addition, the magnet 30 may be covered by a material 52 such as cardboard, vinyl or the like. Thereafter, the material 52 and the panel 26 are covered by an outer material 54 similar or identical to the material used for the handbag, i.e., leather, vinyl or the like.

Referring once again to FIG. 3, an exemplary rear wall 35 of the organizer 38 is shown in cross-section. The rear wall 35 is formed of a material 56 such as leather, vinyl or the like of the type of material from which the organizer type wallet is constructed. The magnetically mutually attractable device in the form of magnet 34 has a polarity which is opposite the facing polarity of attractable magnet 30 in wall 26. For example, the side of magnet 30 facing magnet 34 may be the north pole and the facing side of the magnet 34 may be the south pole so as to provide for the greatest attractive force therebetween. As noted, alternatively other magnetizable materials, e.g, ferromagnetic material such as an iron or steel disc or strip 34 may be embedded in the wall and encased by a material such as cardboard 58 or alternative encasing material, as described in conjunction with magnet 30. Thereafter the internal surface of the wall 35 is layered with a material layer 56 associated with the construction of the handbag, such as leather, vinyl, cloth or the like to shield and cover the magnet 34.

As noted hereinabove, although a neodymium type magnet is disclosed in conjunction with a mutually attractable magnetic disc it should be readily understood that other types of magnets may be utilized without departing from the scope of the invention, as well as combinations of magnets and magnetizable material devices which may be interchanged and reversed in position without departing from the scope of the invention.

Figure 4:
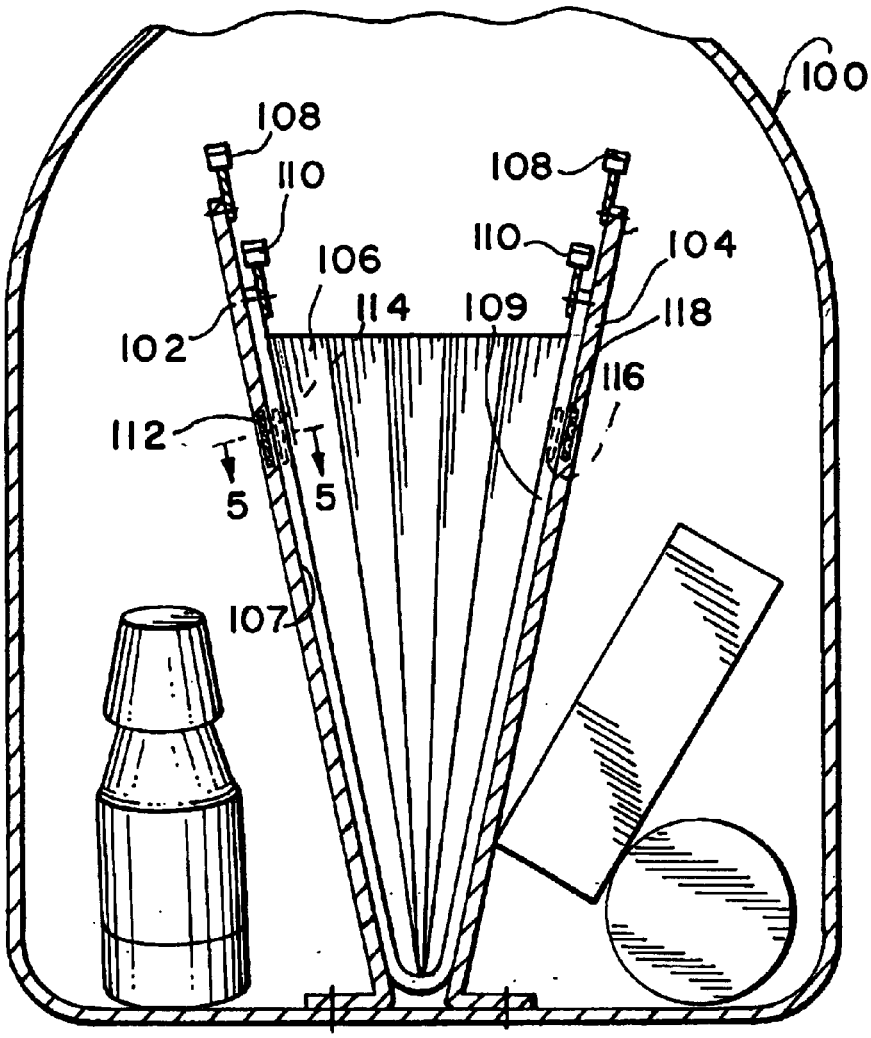
FIG. 4 is an elevational view, partially in cross-section, of an alternative embodiment of an article carrybag or the like, illustrating an internal compartment formed of adjacent wall (or panel) members, the wall members having magnetically attractable devices embedded therein to secure in position an organizer or the like therebetween, the organizer or the like having magnetically attractable materials attached or otherwise embedded in the walls thereof for mutual attraction to the magnetically attractable devices in the walls of the compartment.

Referring now to FIG. 4 there is illustrated an alternative embodiment of the invention wherein a handbag, carrybag or the like 100 is formed in a similar manner to the handbag 10 shown in FIG. 1; however, in FIG. 4 an internal compartment is formed by internal wall panels 102, 104 and are arranged for magnetic reception of a functional device such as an organizer type wallet 106. Alternatively, article 106 may be a coin purse, article holder or the like. As shown in FIG. 4 panels 102, 104 are arranged at an acute angle with respect to each other to complement the particular shape of the article of the organizer or article holder 106, and such panels 102, 104 are sealable or closable by zipper 108, both halves of such zipper 108 being individually attached to wall portions 102 and 104, respectively as shown. Similarly, article holder 106 is closable by zipper 110, having each half respectively attached to one of the walls 107, 109 of the article holder 106. Wall panel 102 contains a magnetically attractable device in the form of a magnet or magnetizable device such as a magnetically attractable metal disc-like member 112, and adjacent wall 107 of article holder 106 contains a magnetic device or magnetically attractable device 114 as shown. Device 112 may be in the form of a neodymium magnet and magnetically mutually attractable device 114 may be in the form of a neodymium magnet or other magnetically attractable magnetizable device such as a disc or strip. Alternatively, device 114 may be in the form of a neodymium or other rare earth-type magnet and device 112 may be in the form of a magnet or a magnetically mutually attractable metal disc. In a similar manner, the opposing wall 109 of article holder 106, and the opposing wall 104 of the handbag may each contain magnetically mutually attractable devices 116 and 118 which may be in the form of magnets 116, 118 which preferably are in the form of a pair of neodymium-type or other rare earth magnets or alternatively, one or more magnets and one or more magnetizable discs or strips attractable to the magnets.

In operation any functional device may be secured to the handbag by magnetic attractive force. In the example illustrated, the article holder, organizer or the like 106 may be separable from walls or panels 102, 104 respectively by manually closing the walls 107, 109 by movement toward each other and by separating them from the respective walls 102, 104 of the handbag. Thereafter, the article holder 106 may be lifted away from the walls 102, 104 for use outside the handbag and replaced into the compartment formed by walls 102, 104 only to be attracted magnetically to the panels or walls 102, 104 for retention within the handbag.

Figure 5:
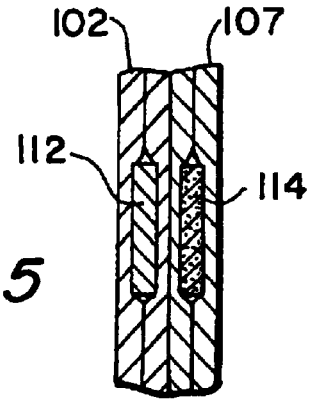
FIG. 5 is a cross-sectional view taken along lines 5—5 of FIG. 4, illustrating the magnetically attractable device of FIG. 4 embedded in a wall of the organizer-type wallet and a magnetically mutually attractable device such as a similar magnet or opposite facing polarity or a metal plate, embedded in the adjacent wall of the compartment formed within the enclosure of the carrybag.

Referring now to FIG. 5 there is shown a cross-sectional view taken along lines 5—5 of FIG. 4, wall or panel 102 in which magnetic device 112 is embedded and wall 107 of article holder 106 in which magnetic device 114 is embedded. As can be seen, in this embodiment wall 102 is formed of a double layer of leather, vinyl or the like and contains a metal disc which is magnetically attractable to a magnet. Wall 107 which forms one of the walls of article holder 106 is formed of a double layer of leather or vinyl enclosing a neodymium magnetic disc 114. In this embodiment the magnet has no encasement or coating (which is optional) purposes of directing the magnetic field, and it does not have a cardboard or other layer as in the previous embodiment.

As noted hereinabove, it should be understood that metal disc-like device 112 may be replaced by a neodymium or other rare magnet and disc-like magnet 114 may be replaced by a magnetically attractable disc-like metal member or metal strip, provided that at least one of the devices is a magnet formed of a magnetic material. In addition, it should be noted that magnets other than rare earth metals may be utilized without departing from the scope of the invention.

In summary, it will be appreciated that the present invention clearly relates to the use of magnetically attractable devices whether in the form of pairs of adjacent repositionable magnets or magnets in combination with magnetically attractable materials, to provide removable attachment of functional devices into compartments or within an entire enclosure formed in whole or in part by handbags, carry cases, gym bags or the like.

It should be further understood that the magnetically mutually attractable devices permit the securement of the article carrying devices within the compartment of the handbag or within the handbag enclosure, while also permitting ready separation from the handbag by the user for use outside of the handbag or carrybag. As noted hereinabove, such arrangements of such devices utilizing magnetically attractable devices are unknown to date.

Figure 6:
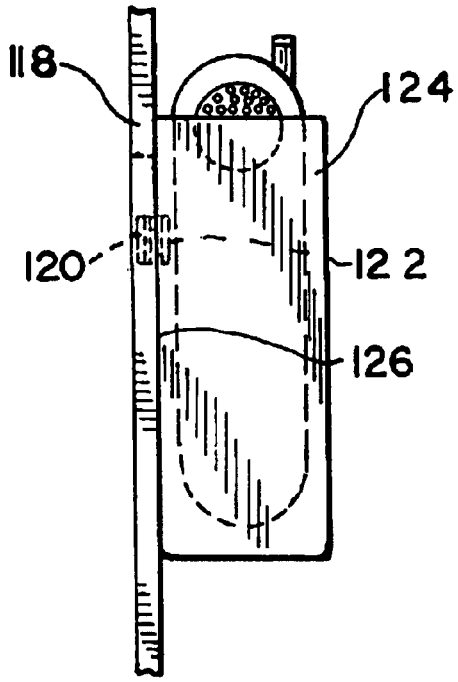
FIG. 6 is an elevational view of an alternative embodiment of the invention, illustrating a typical wall or panel member of a handbag, carrybag or the like, wherein a mobile phone holder is attached to the wall or panel of the carrybag by respective magnetically mutually attractive devices, respectively attached to the mobile phone holder and to the panel of the carrybag.

Referring now to FIG. 6 an alternative embodiment of the invention is illustrated in which an exemplary wall 118 of a carrybag or hand bag is shown in vertical orientation and containing magnet or magnetically attractable device 120 similar to the magnet or magnetically retractable devices disclosed in connection with the previous Figs. An exemplary a mobile phone holder 124 is shown having a wall portion 126 containing a magnetically attractable device 122 embedded in the wall adjacent to vertical wall 118. As disclosed in the previous embodiments the mobile phone holder may be attached to the vertical wall 118 by the mutually magnetically attractable devices 120, 122 and separated therefrom for use outside the handbag.

Referring to FIG. 6, still another alternative embodiment is shown wherein a vertical wall or panel 128 contains a magnetic or magnetically attractable device 130 similar to the device shown in FIG. 6. However in FIG. 6 a wallet or coin holder 132 is attached to vertical wall 128 by magnetically attractable device 134 which is embedded in one of the walls of the wallet or coin holder 132. Wallet or coin holder 132 may be readily separable from the vertical wall 128 for use outside the handbag and is readily reinsertable into position within the handbag or carrybag by the magnetic attraction of the respective devices 130, 134.

Figure 7:
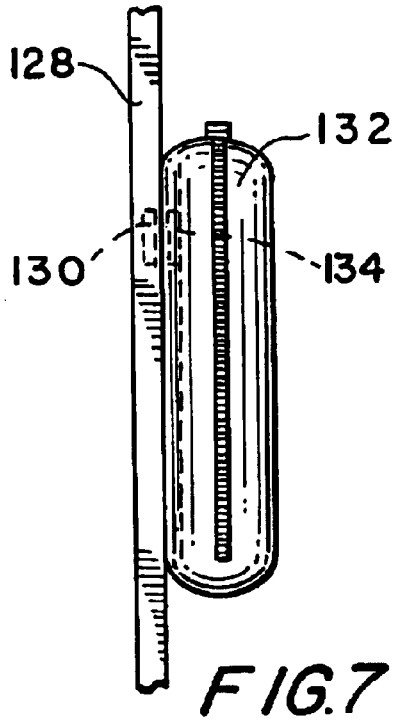
FIG. 7 is an elevational view of yet another alternative embodiment of the invention, illustrating a wall or panel member of a handbag, carrybag or the like, utilized to removably attach a functional device such as a wallet thereto by mutually magnetically attractive devices, the wall or panel member of the carrybag having either a magnet or a magnetically attractable device embedded therein and the wallet or other functional device having either a magnet of opposite facing polarity, or a magnetizable magnetically attractable device such as an iron or steel metal plate, attached thereto for securing the wallet to the wall or panel of the carry device.

In FIGS. 6 and 7 vertical panels or walls 118, 128 may be internal walls of a handbag or carrybag or alternatively, they may be an outside wall or a wall forming part of an internal or semi-internal compartment similar to the compartment shown in conjunction with FIGS. 1 and 2. Moreover, it will be readily appreciated that the present invention may be practiced as in the embodiments of FIGS. 1 and 4 whereby magnetic devices are positioned on more than one side of the functional device to retain it in portion, or alternatively as in FIGS. 6 and 7 whereby the functional device may be attached to a single wall by one pair of magnetically attractive devices.

Although the subject invention has been described with respect to perferred embodiments, it will be readily apparent to those having ordinary skill in the art to which it appertains, that changes and modifications may be made thereto without departing from the spirit or scope of the subject invention as defined by the appended claims.

What is claimed is:

1. A handbag for carrying articles which comprises:

a) an enclosure which defines a primary storage space accessible through a primary opening of said enclosure;

b) at least one external compartment which is inaccessible through said primary storage space, said external compartment including a closure panel pivotably movable toward and away from said enclosure for selectively providing access thereto;

c) a wallet for carrying articles and information, said wallet having at least first and second walls pivotably movable at least between a closed condition of said wallet, and an open condition of said wallet, said wallet being removably positionable within said at least one external compartment and having an opening generally parallel to said primary opening of said enclosure when positioned within said external compartment, said wallet having independent closure means to selectively permit access thereinto; and d) mutually magnetically attractable devices respectively attached directly to a respective inner wall and said closure panel of said at least one compartment and directly to said first and second walls of said wallet without use of any extension member for, removably retaining said wallet in position within said at least one compartment by magnetic attractive force respectively between said inner wall and said closure panel and said first and second walls of said wallet, while permitting separation of said wallet from said at least one compartment, whereby pivotable movement of said closure panel of said at least one compartment toward and away from said enclosure causes corresponding pivotable movement of at least one of said first and second walls of said wallet between said closed and open conditions of said wallet, and separating said walls of said wallet from said compartment reduces the magnetic attractive force therebetween and permits removal of said wallet by lifting said wallet from said at least one compartment.

2. The handbag according to claim 1, wherein said enclosure is comprised of opposed front and rear walls, opposed side walls, and a bottom wall, said walls defining said primary storage space.

3. The handbag according to claim 2, wherein said mutually magnetically attractable devices comprise magnetic or magnetizable devices.

4. The handbag according to claim 3, wherein said magnetically attractable devices are respectively positioned in opposed adjacent relation with each other when said wallet is positioned within said at least one compartment, said magnetically attractable devices for providing magnetic force for separably retaining said wallet in said at least one compartment.

5. A handbag which comprises:

a) an enclosure having at least opposed front and rear walls, opposed side walls, and a bottom wall, said walls defining a primary storage space accessible through a primary opening of said enclosure;

b) at least one external compartment which is inaccessible through said primary storage space, said external compartment having an inner wall comprised of one of said walls, said at least one external compartment having at least one closure panel pivotably movable toward and away from said inner wall between closed and open positions to close and open said at least one external compartment, respectively;

c) at least one first magnetically attractable device attached to said closure panel;

d) at least one second magnetically attractable device attached to said inner wall of said at least one external compartment; and e) at least one wallet for carrying articles or information and having at least two walls pivotably movable at least between close and open positions to close and open said wallet, said at least two walls each having a magnetically attractable device attached directly thereto without use of any extension member, said at least two walls respectively positionable adjacent said inner wall and said closure panel and said first and second magnetically attractable devices attached thereto, whereby said wallet may be separably attached to said compartment by magnetic attractive force of said first and second magnetically attractable devices, and movement of said closure panel between said closed and open positions correspondingly causes corresponding pivotable movement of at least one of said at least two walls of said wallet to move between said closed and open positions, and separating said two walls of said wallet respectively from said inner wall and said closure panel reduces the magnetic attractive force therebetween and permits removal of said wallet by lifting said wallet from said compartment, said wallet having an opening generally parallel to said primary opening of said enclosure when positioned within said at least one external compartment, said wallet having independent closure means to selectively permit access thereinto.

6. A handbag which comprises:

a) an enclosure having opposed front and rear walls, a bottom wall, and side walls defining a primary storage space accessible through a primary opening;

b) an external compartment having an inner wall formed by one of said walls, and being inaccessible from said primary storage space;

c) a closure panel associated with said at least one wall and arranged for pivotable movement toward and away from said at least one wall so as to selectively close and open said compartment;

d) at least one first magnetically attractable device attached to said closure panel;

e) at least one second magnetically attractable device attached to said inner wall of said external compartment; and f) a wallet for carrying articles or information and arranged for separable positioning within said compartment, said wallet having at least two walls pivotably movable between closed and open positions, said at least two walls each having attached directly thereto at least one magnetically attractable device for removably attaching said wallet within said compartment without use of any extension member, by positioning said respective attractable devices in adjacent magnetically attractive relation with said first and second magnetically attractable devices so as to develop mutual magnetic attractive force between said magnetically attractable devices, whereby pivotable movement of said closure panel toward and away from said inner wall correspondingly causes at least one of said walls of said wallet to pivotably move between said closed and open positions, and separating said walls of said wallet from said inner wall and said closure panel respectively reduces the magnetic force therebetween and permits removal of said wallet from said compartment by lifting said wallet therefrom.

7. The handbag according to claim 6, wherein said wallet includes a plurality of panels positioned therein and spaced apart from each other for separating articles.

8. The handbag according to claim 7, wherein said magnetically attractable devices are rare earth magnets the opposed mutually magnetically attractable devices are magnets or magnetizable material capable of being magnetically attracted to said rare earth magnets.

9. The handbag according to claim 8, wherein said rare earth magnet or magnets are neodymium magnets.

10. A method of separably attaching a wallet to a handbag, said wallet having two pivotably movable walls, said handbag having opposed front and rear walls, opposed side walls, said walls defining a primary storage space accessible through a primary opening, and an external compartment having at least one inner wall comprised of at least one of said walls of said handbag, and a closure panel pivotably movable between respective positions to open and close said external compartment, comprising:

a) attaching a first magnetically attractable device to said closure panel of said compartment;

b) attaching a second magnetically attractable device to said inner wall of said external compartment; and c) attaching third and fourth respective magnetically attractable devices directly to said pivotably movable walls of said wallet, without use of any extension member, at locations whereby said wallet may be separably positioned adjacent said closure panel of said compartment whereby said first and third and said second and fourth magnetically attractable devices are respectively positioned in adjacent relation so as to develop magnetically attractive force therebetween to separably attach said wallet to said compartment, and pivotable movement of said closure panel causes corresponding pivotable movement of at least one of said walls of said wallet, and separating said walls of said wallet from said compartment reduces the magnetic force therebetween and permits removal of said wallet from said compartment by lifting said wallet therefrom.

11. A device for carrying articles which comprises:

a) an enclosure having a primary opening to provide access thereto and an external compartment inaccessible through said enclosure;

b) a wallet for carrying articles or information, said wallet having at least two walls pivotable between closed and open positions and having a zipper closure to selectively permit access into the wallet, said wallet being removably positionable within said extended compartment, said external compartment having an inner wall and a closure panel adjacent said wallet, said closure panel being pivotably movable between closed and open positions respectively toward and away from said enclosure to selectively close and open said compartment; and c) mutually magnetically attractable devices respectively attached to said inner wall and said closure panel of said compartment and directly to said walls of said wallet without use of any extension member, for retaining said wallet in position with respect to said compartment by magnetic attractive force, whereby pivotable movement of said closure panel of said compartment between said closed and open positions causes corresponding pivotable movement of at least one of said pivotable walls of said wallet adjacent thereto, and separating said pivotable walls of said wallet respectively from said inner wall and said closure panel reduces the magnetic force therebetween and permits removal of said wallet by lifting said wallet from said compartment.

12. The handbag according to claim 5, wherein said wallet renders the appearance of permanent attachment to said compartment.

13. A handbag for carrying articles, which comprises:

a) an enclosure in the form of a handbag which includes a primary storage space and a primary opening to provide access to said primary storage space which defines;

b) at least one external compartment which is inaccessible through said primary storage space and accessible through a closure panel, said at least one external compartment having an inner wall, said closure panel being pivotably movable toward and away from said inner wall;

c) a wallet for carrying articles or information, said wallet having at least first and second walls pivotably movable at least between first and second positions, at least one of said positions corresponding to a closed condition of said wallet, and the other of said positions corresponding to an open condition of said wallet, said wallet being removably positionable within said at least one external compartment;

d) magnetically attractable devices respectively attached to said inner wall of said at least one compartment and to said closure panel; and e) mutually magnetically attractable devices attached directly to said first and second walls of said wallet, without use of any extension member, for removably retaining said wallet in position within said at least one compartment by magnetic attractive force while permitting separation of said wallet from said at least one compartment, whereby pivotable movement of said closure panel of said compartment toward and away from said inner wall causes corresponding pivotable movement of at least one of said first and second walls of said wallet between closed and open conditions of said wallet, and separating said first and second walls of said wallet respectively from said inner wall and said closure panel of said compartment reduces the magnetic attractive force therebetween and permits removal of said wallet by lifting said wallet from said compartment.

14. A handbag for carrying articles, which comprises:

a) an enclosure having opposed front and rear walls, a bottom wall, and side walls defining a primary storage space accessible through a primary opening of said enclosure;

b) an external compartment which is inaccessible through said primary storage space and which is accessible through a closure panel pivotably movable between closed and open positions respectively toward and away from said enclosure, said external compartment having a fixed inner wall formed of one of said walls defining said primary storage space;

c) a wallet for carrying articles, said wallet having at least two walls pivotably movable at least between first and second positions, at least one of said positions corresponding to a closed condition of said wallet, and the other of said positions corresponding to an open condition of said wallet, said wallet being removably positionable within said at least one compartment; and d) magnetically attractable devices respectively attached to said fixed inner wall of said external compartment and on said closure panel and mutually magnetically attractable devices attached directly to said at least two walls of said wallet, without use of any extension member, for removably retaining said wallet in position within said external compartment by magnetic attractive force while permitting separation of said wallet from said external compartment, whereby pivotable movement of said closure panel of said compartment toward and away from said enclosure causes corresponding pivotable movement of at least one of said walls of said wallet between closed and open conditions of said wallet, and separating said at least two walls of said wallet from said fixed inner wall of said compartment and said closure panel, respectively, reduces the magnetic attractive force therebetween and permits removal of said wallet by lifting said wallet from said compartment.

15. The handbag according to claim 14, wherein said magnetically attractable devices and said mutually magnetically attractable devices are respectively provided in pairs, one pair of said devices being attached to a wall of said wallet and said fixed inner wall of said compartment, and the other of said pair of devices being attached to the other of said walls of said wallet and to said closure panel.

16. The handbag according to claim 15, wherein at least one of each said pairs of mutually magnetically attractable devices is a rare earth magnet.

17. The handbag according to claim 16, wherein each said pair of magnetically attractable devices and mutually magnetically attractable devices are rare earth magnets, and each said rare earth magnet is a neodymium magnet.

* * * * *